US008539635B2

(12) United States Patent
Shinler et al.

(10) Patent No.: US 8,539,635 B2
(45) Date of Patent: Sep. 24, 2013

(54) INTEGRATED VACUUM WAND AND METHOD OF USE

(75) Inventors: Kevin L. Shinler, North Branch, MN (US); John C. Ickes, Rockford, MN (US); Matthew Betteker, Phoenix, AZ (US); Bruce M. Becker, Bloomington, MN (US)

(73) Assignee: Tennant Company, Minneapolis, MN (US)

( * ) Notice: Subject to any disclaimer, the term of this patent is extended or adjusted under 35 U.S.C. 154(b) by 456 days.

(21) Appl. No.: 12/943,000

(22) Filed: Nov. 9, 2010

(65) Prior Publication Data

US 2011/0108067 A1 May 12, 2011

Related U.S. Application Data

(60) Provisional application No. 61/259,620, filed on Nov. 9, 2009, provisional application No. 61/303,219, filed on Feb. 10, 2010.

(51) Int. Cl.
*A47L 7/00* (2006.01)

(52) U.S. Cl.
USPC ..... 15/321; 15/320; 15/322; 15/328; 15/334; 15/417

(58) Field of Classification Search
USPC ..... 15/320, 321, 322, 328, 334, 417; 134/21, 42
See application file for complete search history.

(56) References Cited

U.S. PATENT DOCUMENTS

| | | | | |
|---|---|---|---|---|
| 2,248,699 | A * | 7/1941 | Finnell | 15/320 |
| 4,893,375 | A | 1/1990 | Girman et al. | |
| 6,581,974 | B1 | 6/2003 | Ragner et al. | |
| 2006/0070205 | A1 | 4/2006 | Fischer et al. | |

OTHER PUBLICATIONS

International Search Report and Written Opinion for PCT/US2010/056092, mailed Jan. 10, 2011.

* cited by examiner

*Primary Examiner* — Saeed T Chaudhry
(74) *Attorney, Agent, or Firm* — Briggs and Morgan, P.A.; John F. Klos

(57) ABSTRACT

A portable vacuum wand for use with a surface maintenance machine, for collection of debris remote from the machine. The vacuum wand is detachable from a rear squeegee assembly of the surface maintenance machine, and includes a handle and a wand head. A vacuum conduit of the vacuum wand is adapted to be coupled to the rear squeegee assembly when not in use so as to provide vacuum to the rear squeegee assembly. A method of cleaning a floor surface with a surface maintenance machine and a portable vacuum wand is also provided.

25 Claims, 23 Drawing Sheets

INTEGRATED VACUUM WAND AND METHOD OF USE

RELATED APPLICATIONS

This application claims the benefit of U.S. Provisional Application Nos. 61/259,620, filed Nov. 9, 2009, and 61/303,219, filed Feb. 10, 2010, and each incorporated herein by reference.

FIELD OF THE INVENTION

The present invention relates to debris collection vehicles and particularly to such vehicles utilizing a vacuum recovery system. More specifically, the invention is concerned with a portable removable wand for use by the vehicle operator to collect debris away from the vehicle.

BACKGROUND OF THE INVENTION

Surface maintenance vehicles and cleaning devices have a long history subject to gradual innovation and improvement toward improved and oftentimes automated performance in removing debris and contamination from floors. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ a squeegee assembly for removing solution from a floor which has been cleaned by application of a cleaning solution of water and a detergent in conjunction with scrubbing action of one or more moving brushes. Accordingly, the squeegee assembly of such prior art cleaning vehicles often mounts at or near the rear of the surface maintenance vehicle to direct the solution to a removal location where the solution (including suspended dirt, particles and contaminants) is removed. The cleaning solution is typically supplied to the floor surface through or near rotary scrub brushes operating from a lower portion of the vehicle. The squeegee assembly may include a squeegee supporting member of generally arcuate configuration with two squeegee blades spaced apart and affixed to the supporting member to promote consistent contact with the surface to be cleaned and wiped.

The prior art includes surface maintenance vehicles having portable wands for debris collection away from the vehicle. Typically, the wands require the operator to connect the portable wand into a vacuum system via a stored hose. A valve is often used to control vacuum pickup via the portable wand. The valve is accessed to control vacuum supplied to the wand.

A drawback of the prior art systems includes the cumbersome and sometimes tedious procedure through which a portable vacuum wand is inserted into the vacuum system of the floor surface maintenance machine.

SUMMARY OF THE INVENTION

The present invention relates to a mobile floor surface maintenance machine, such as a wet scrubber, of the type using a rear squeegee assembly for recovering soiled cleaning solution via a vacuum device which in addition includes a portable wand, mounted on the vehicle, but removable by the operator for collection of solution/debris away from the vehicle.

A primary purpose of the invention is a portable wand assembly as described in which the flexible vacuum hose connecting the wand assembly to the vehicle remains in use (activated) even when the wand is replaced upon the vehicle and not in use. A flexible vacuum conduit is adapted for use with the portable wand and for use with the rear squeegee assembly.

Another purpose of the invention is a debris collection vehicle as described in which the wand assembly includes a pivot adapter for adjusting the angular orientation of a debris wand head relative to a surface to be cleaned.

Another purpose of the invention is a vacuum operated debris collection wand assembly in which a handle permitting movement of the wand for debris collection collapses for storage.

Yet another purpose of the invention is a vacuum operated debris collection wand assembly wherein a wand head easily couples with a vacuum outlet of a rear squeegee assembly.

Other purposes will appear in the ensuing specification, drawings and claims. The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
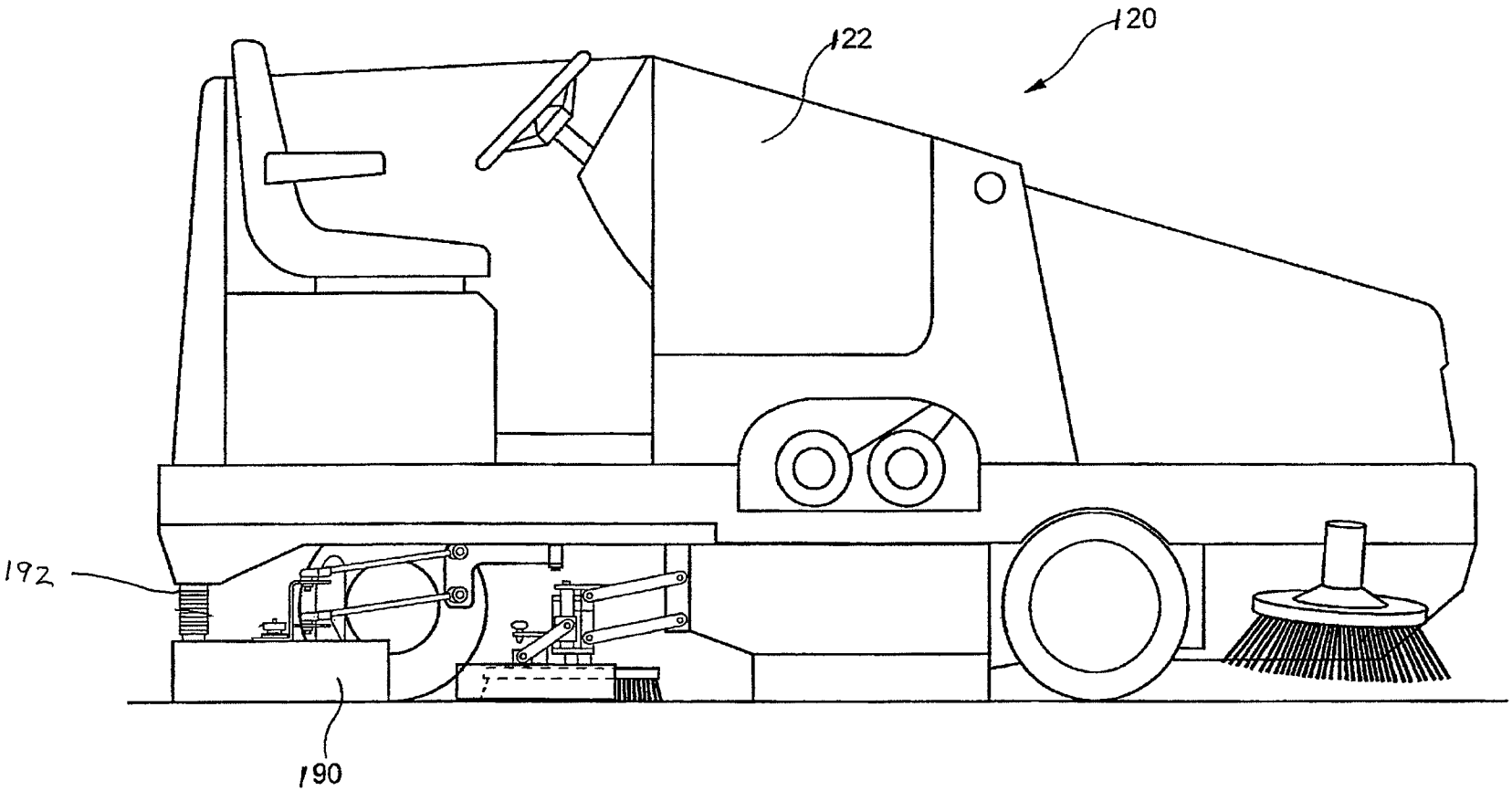
FIG. 1 is an illustration of a prior art surface maintenance machine suitable for use with the wand assembly of the present invention.
Figure 2:
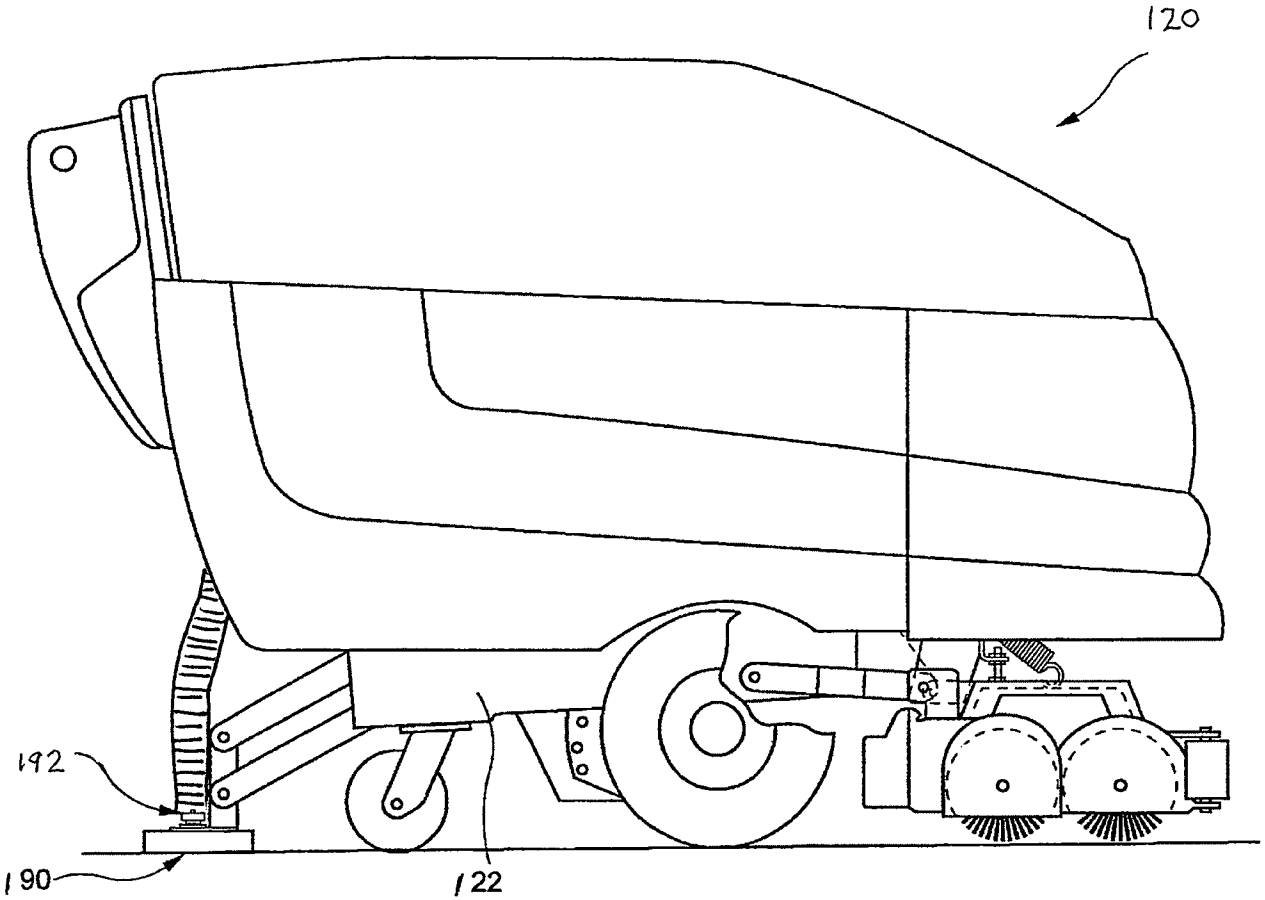
FIG. 2 is an illustration of another prior art surface maintenance machine suitable for use with the wand assembly of the present invention.

Industrial sweeper-scrubbers which may utilize the present invention are shown in FIGS. 1 and 2. These surface maintenance machines may be used for sweeping and/or scrubbing floors in factories, warehouses, and other industrial or commercial establishments. As shown in FIG. 1, a riding-type surface maintenance vehicle 120 has a frame 122, and is supported on a plurality of front and rear wheels. Typically, such a surface maintenance vehicle 120 includes a variety of implements such as brushes and systems for dispensing cleaning solutions typically composed of detergent and water which suspend dirt. A rear squeegee assembly 190 is coupled to a vacuum system via vacuum line 192. Herein, a cleaning solution containing suspended dirt and other particles shall be called a "loaded cleaning solution." Loaded cleaning solution and other liquid material are usually removed by a wiper blade assembly, referred to as a squeegee assembly. One example of such a surface maintenance vehicle is disclosed in U.S. Pat. No. 5,455,985, assigned to Tennant Company, the assignee herein, and incorporated herein by reference in its entirety. Alternatively, FIG. 2 illustrates a walk-behind surface maintenance vehicle, such as the floor scrubbing vehicle disclosed in U.S. Pat. No. 5,483,718, assigned to Tennant Company, the assignee herein, and incorporated herein by reference. The vehicle 120 includes a frame 122, rear squeegee assembly 190 and vacuum line 192. The particular surface maintenance vehicles illustrated in FIGS. 1 and 2 are relevant insofar as depicting the preferred environment with which the present invention is concerned.

Figure 3:
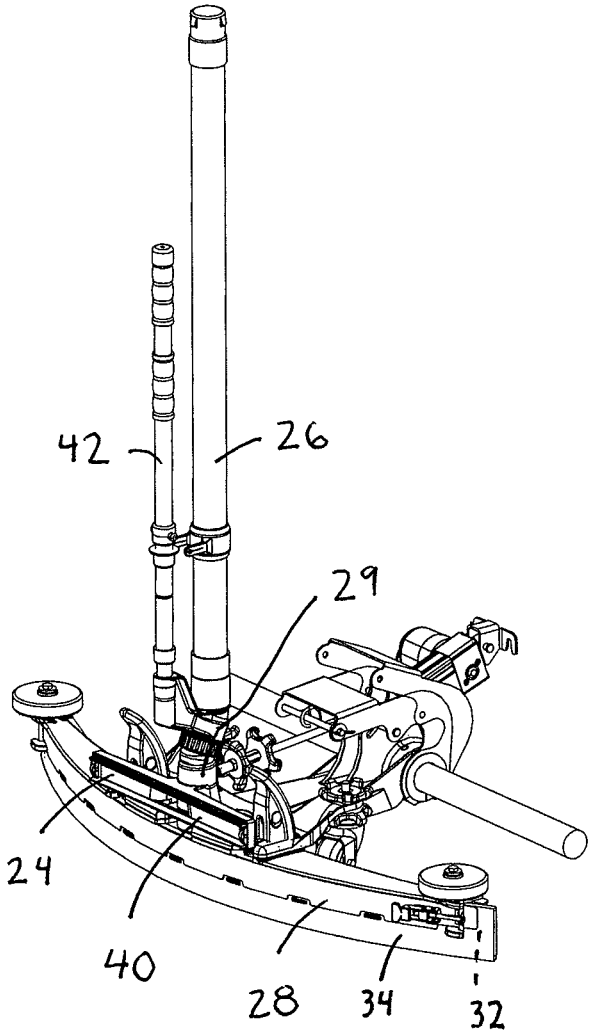
FIGS. 3-5 are perspective illustrations of a wand assembly of the present invention as attached to a rear squeegee assembly of a surface maintenance machine.

Referring now to FIG. 3-16, a first embodiment of wand assembly 24 of the present invention includes a wand head 40 connected to a tubular, telescoping handle 42. The wand head 40 is coupled to flexible, collapsible vacuum hose 26. As described hereinafter, wand head 40 is adapted to be removed from rear squeegee assembly 28 to allow for remote debris pickup. Vacuum hose 26 remains coupled to wand head 40 and extends in length during remote debris pickup. When the wand is not in use, as shown in FIG. 3, the vacuum hose 26 provides the vacuum to the rear squeegee assembly 28 via adapter 29. The opposite end of vacuum hose 26 is operatively coupled to a vacuum fan which will supply vacuum to the hose 26.

A debris collection vehicle may be a wet floor scrubbing machine having cleaning liquid dispensing systems, scrubbing pads, and a rear squeegee assembly 28. Squeegee assembly 28 includes a front squeegee blade 32 and a rear squeegee blade 34. Additional aspects of rear squeegee assembly 28 are disclosed in U.S. Provisional patent application Ser. No. 61/259,421, entitled Squeegee Assembly, and incorporated by reference herein. The vehicle carrying the wand assembly includes a vacuum tank for receiving soiled cleaning solution via vacuum hose 26.

Figure 4:
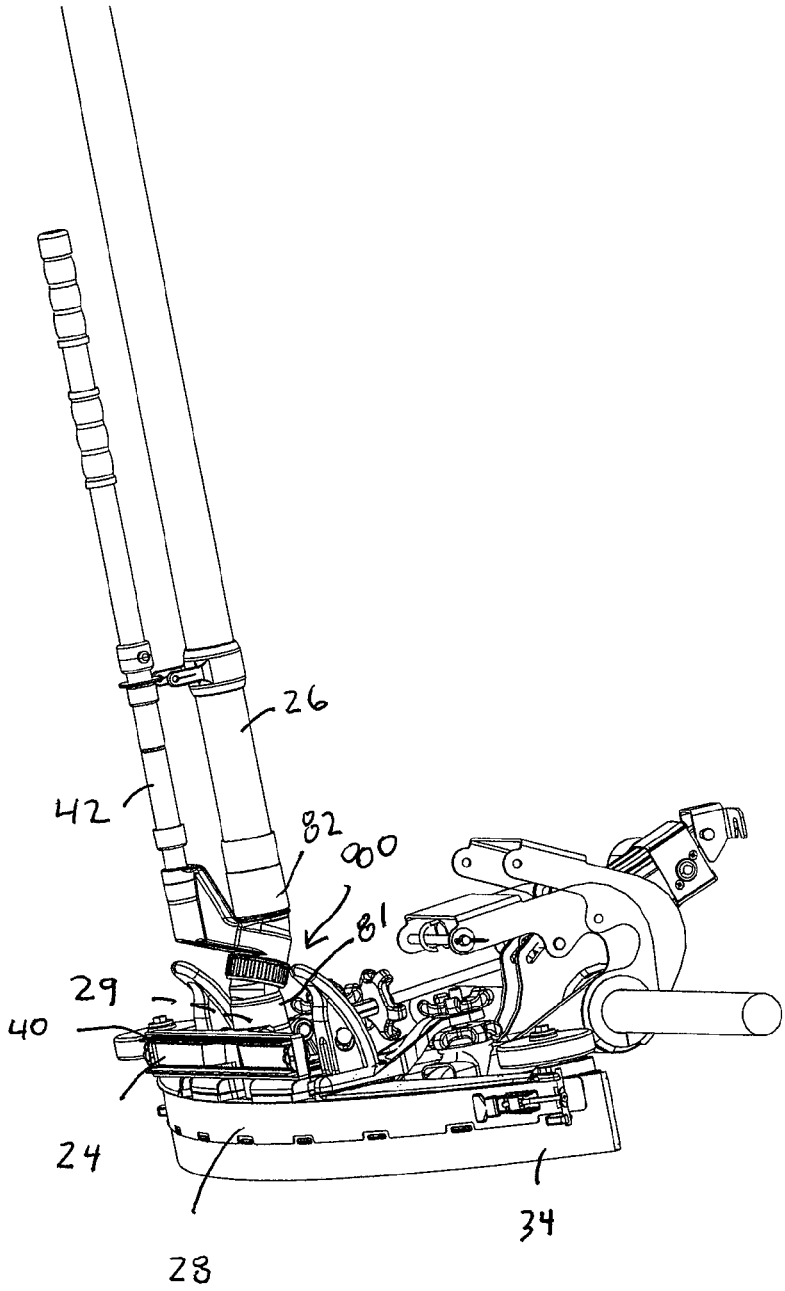
Figure 8:
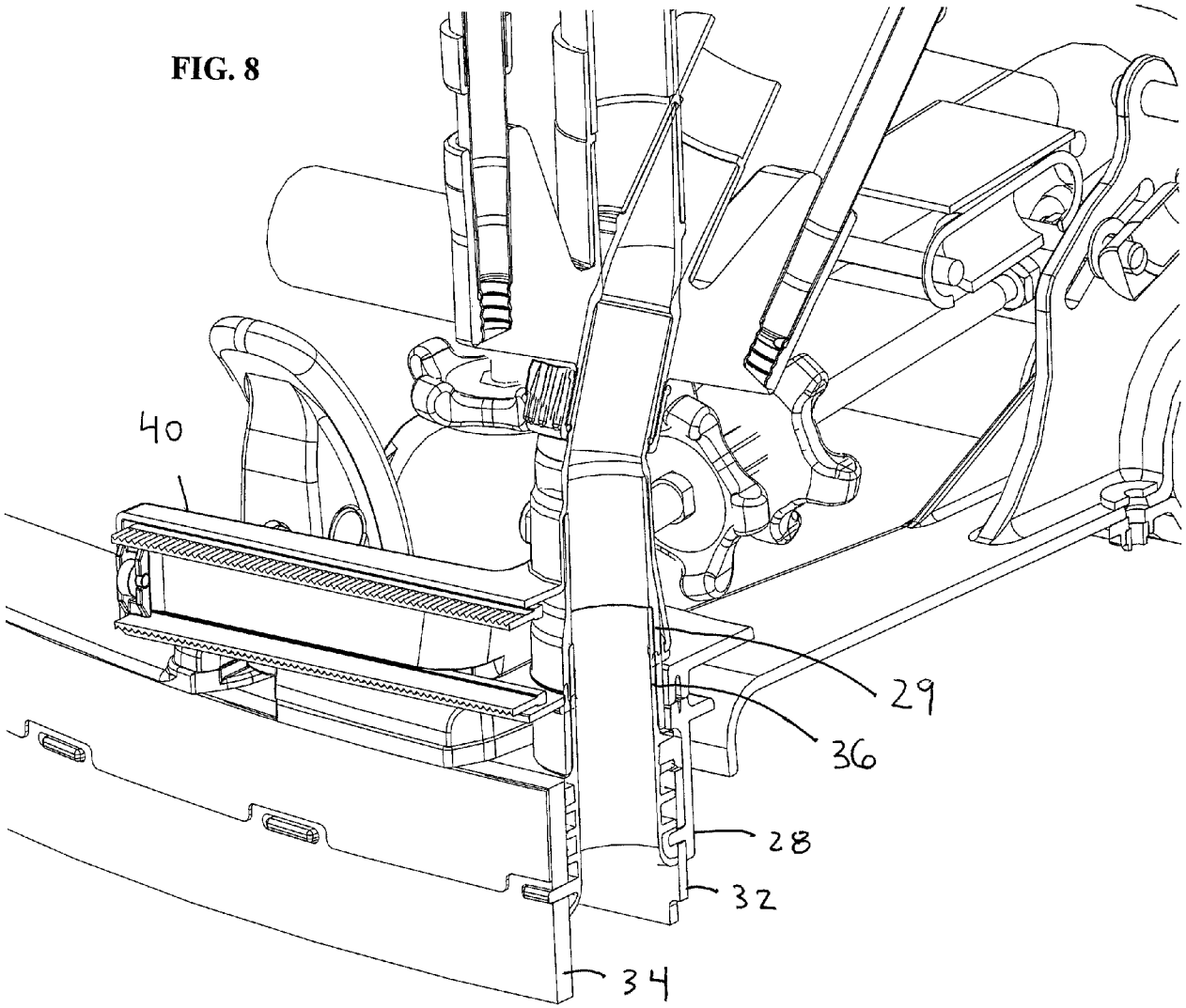
FIG. 8 is a cross sectional view of the wand assembly and rear squeegee assembly of FIG. 3.

FIG. 4 also shows the stored or captured position of wand assembly 24. When stretched to its full extent by the operator's removal of the wand from the vehicle, the hose may permit the operator to collect debris at a distance as great as 15 feet from the vehicle. Wand assembly 24 includes a head 40 which defines a coupling 29 adapted to be secured onto the vacuum outlet 36 of the rear squeegee assembly 28 as shown in FIG. 8. In the illustrated embodiment, coupling 29 defines a female adapter for coupling with a vacuum outlet 36 of the rear squeegee assembly 28.

Wand assembly 24 includes a swivel adapter 80 which is assembled into two sections, head member 81 and handle member 82. These two sections 81, 82 are pivotally attached, and can pivot with respect to each other around a pivot axis. The pivot axis is angled off-axis with respect to the longitudinal axis of the handle 42 to allow various angled positions for adapter 80. Adapter 80 thus forms a pivot joint which allows the wand head 40 to change its angular orientation relative to handle 42.

Figure 5:
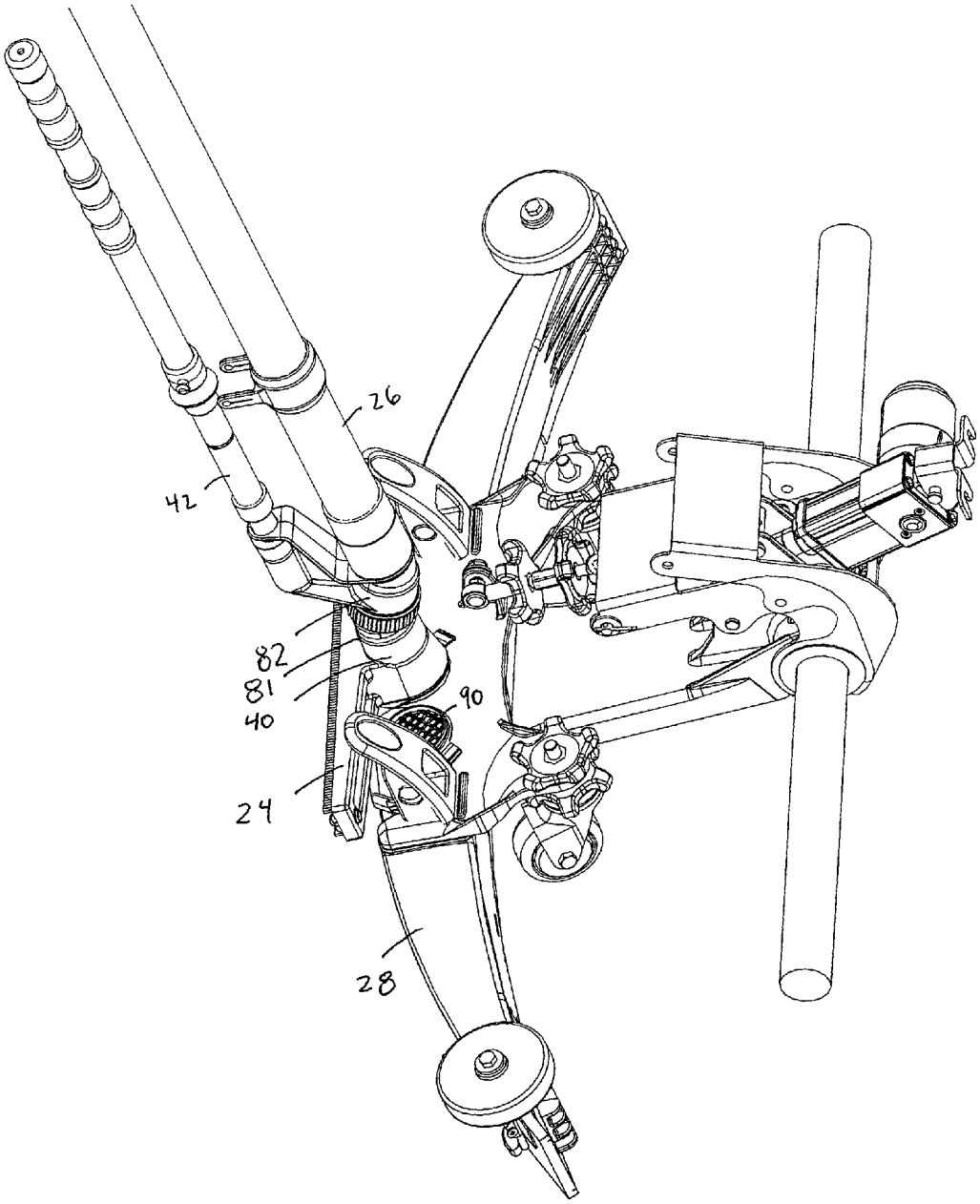
Figure 6:
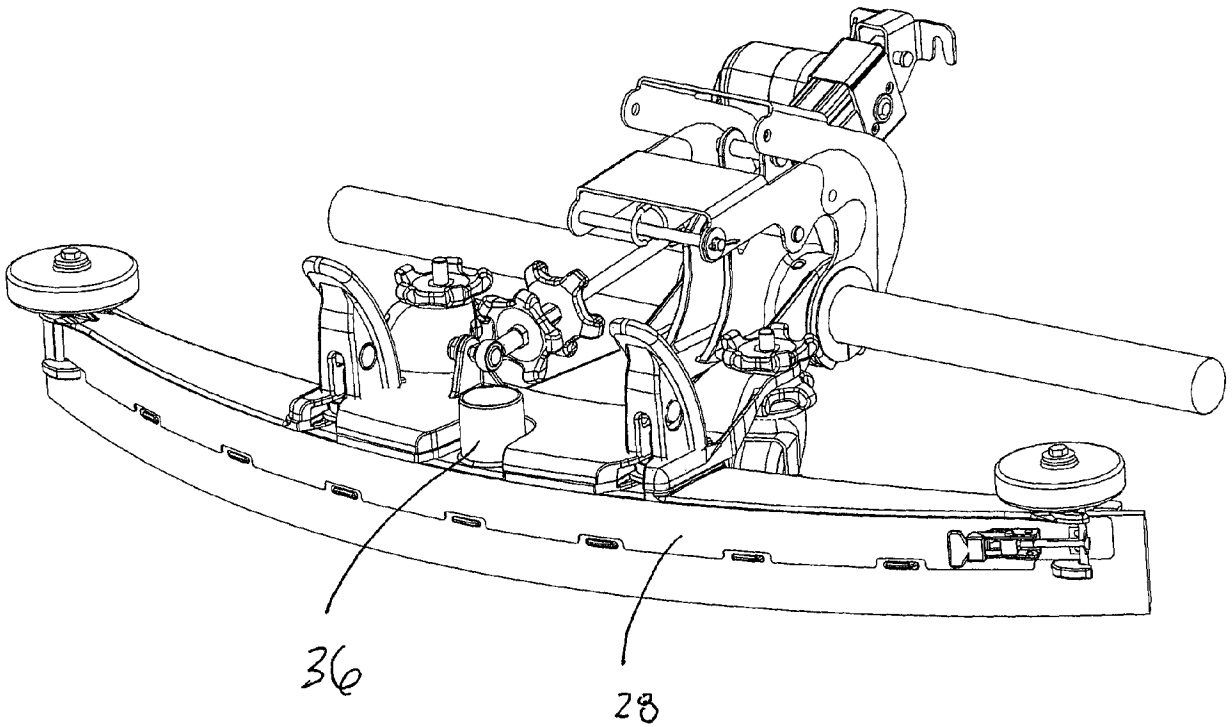
FIG. 6 is a perspective illustration of a rear squeegee assembly of a surface maintenance machine suitable for use with the wand assembly of FIG. 3.

FIG. 5 illustrates the wand assembly 24 connected to rear squeegee assembly 28. FIG. 6 shows the rear squeegee assembly 28. Coupling 29 is sized to receive a portion of vacuum outlet 36 in a substantially air tight manner.

Figure 7:
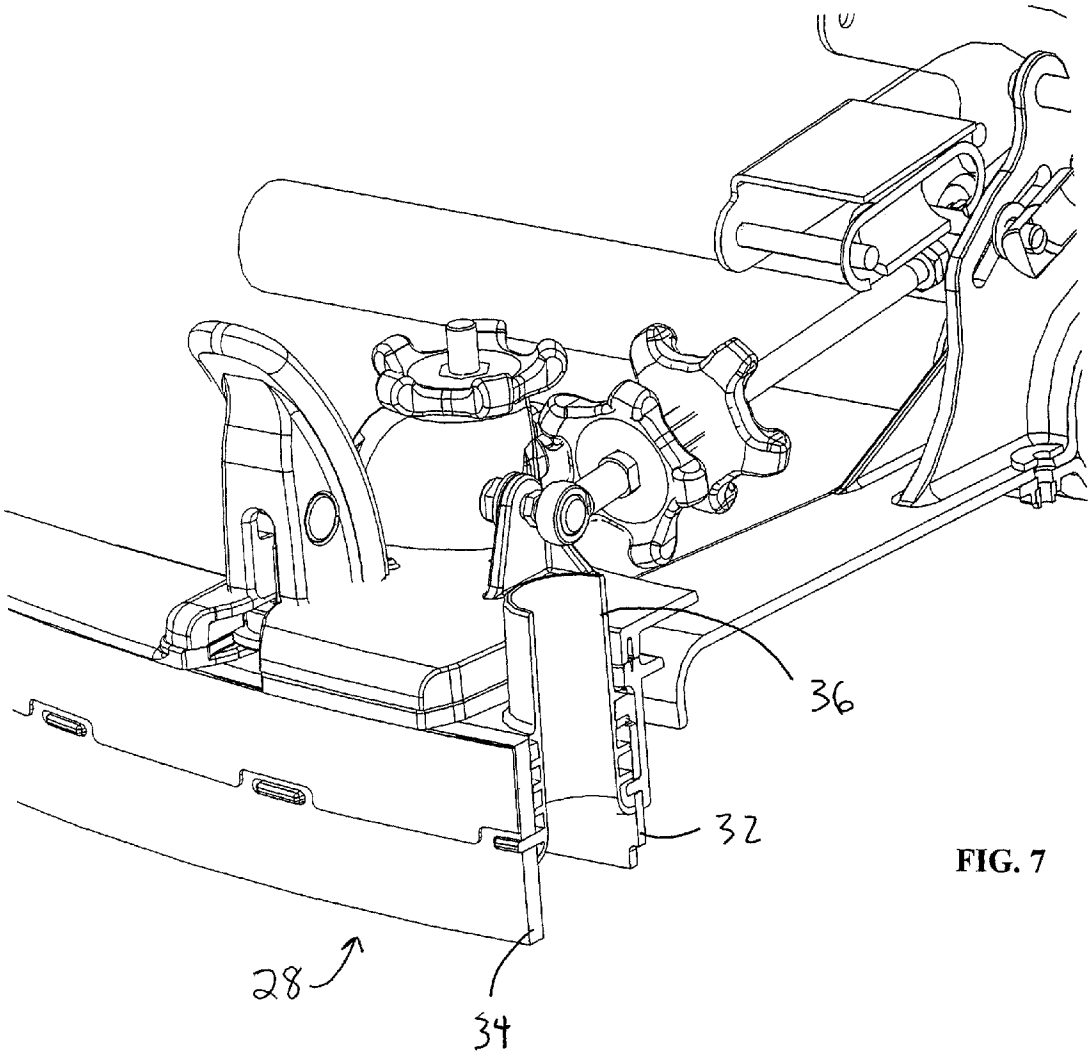
FIG. 7 is a cross sectional view of the rear squeegee assembly of FIG. 6.

FIG. 7 is a cross sectional view taken through rear squeegee assembly 28, showing that vacuum outlet 36 is in communication with the region between the front and rear squeegee blades 32, 34.

FIG. 8 is a cross sectional view taken through rear squeegee assembly 28 and wand assembly 24 showing the connection between head 40 and squeegee vacuum outlet 36.

Figure 9:
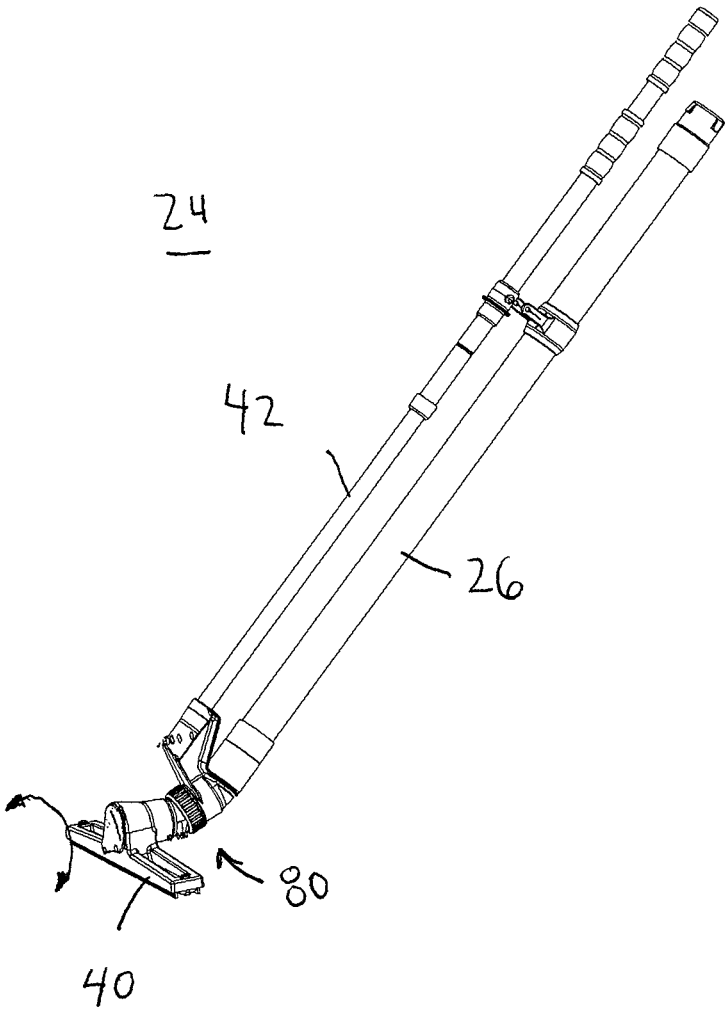
FIGS. 9-11 are perspective illustrations of the wand assembly of FIG. 3.

FIG. 9 is a view of the wand assembly 24 depicted as removed away from squeegee assembly 28, such as during remote use to remove spills or other debris.

Figure 10:
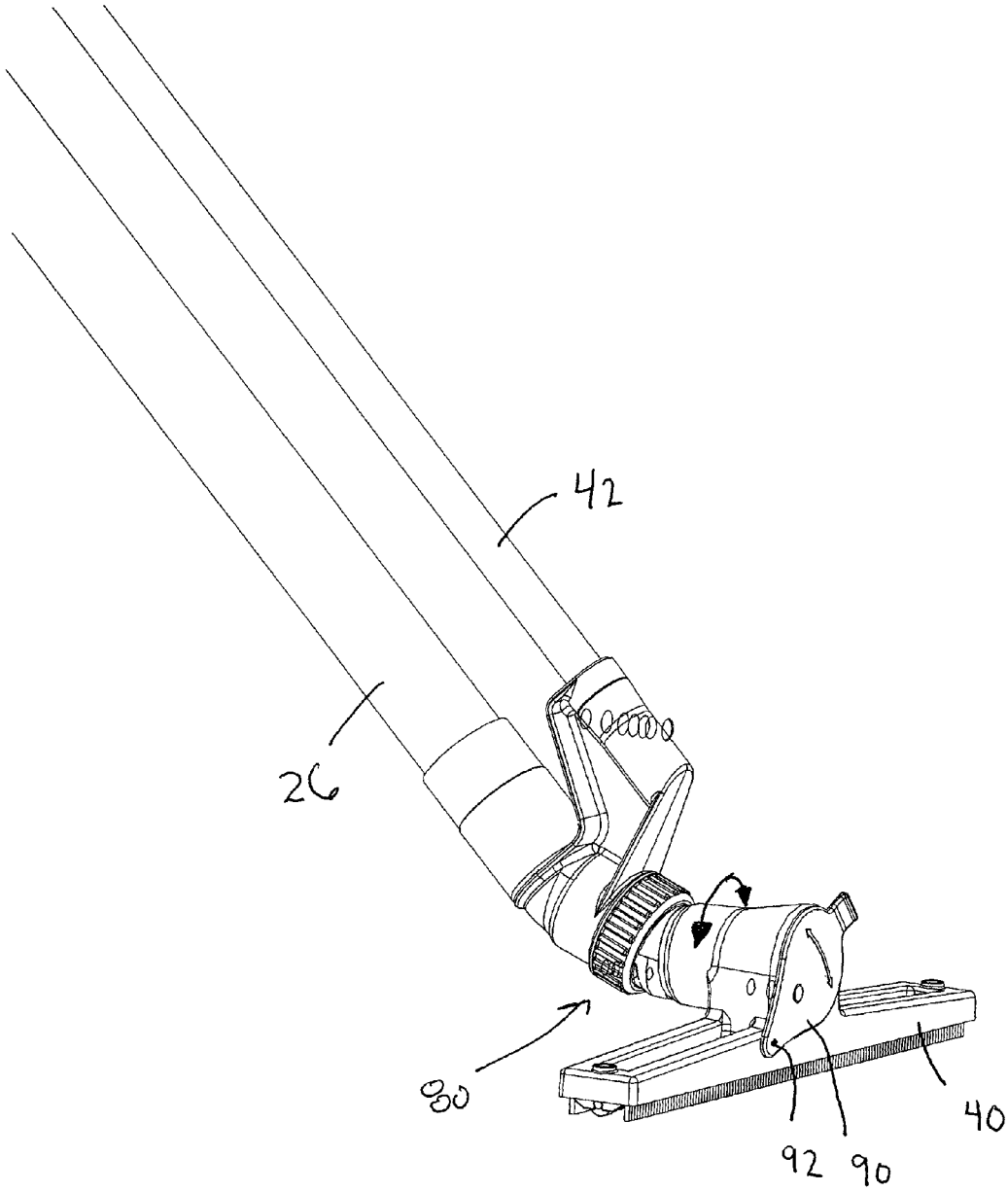

FIG. 10 is another view of the wand assembly 24 showing a flexible plug 90 which pivots about point 92. Plug 90 is opened and rotated to allow squeegee vacuum outlet 36 to be inserted into coupling 29 of head 40 as shown in FIG. 5. When wand assembly 24 is being used, plug 90 is rotated to seal the opening of coupling 29.

Figure 11:
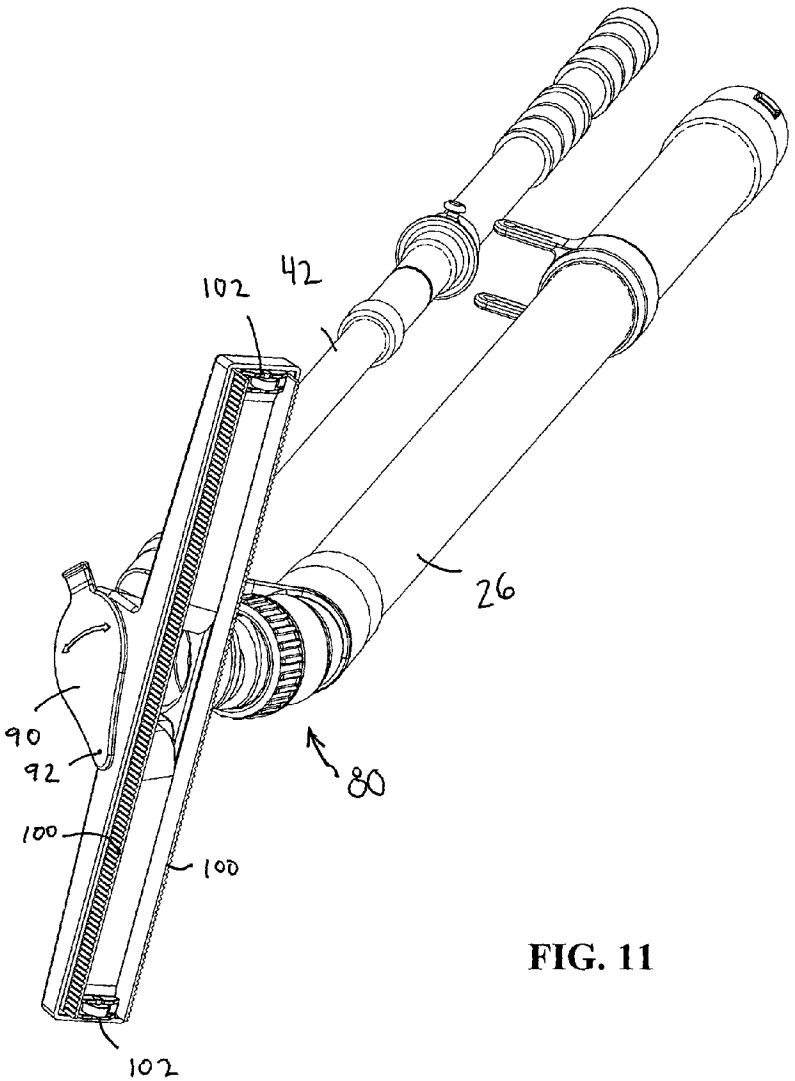

FIG. 11 is another view of the wand assembly 24 showing a pair of squeegee blades 100 and a pair of rollers 102 for engaging a surface to be cleaned. The rollers 102 limit the degree of deflection of squeegee blades 100.

Figure 12:
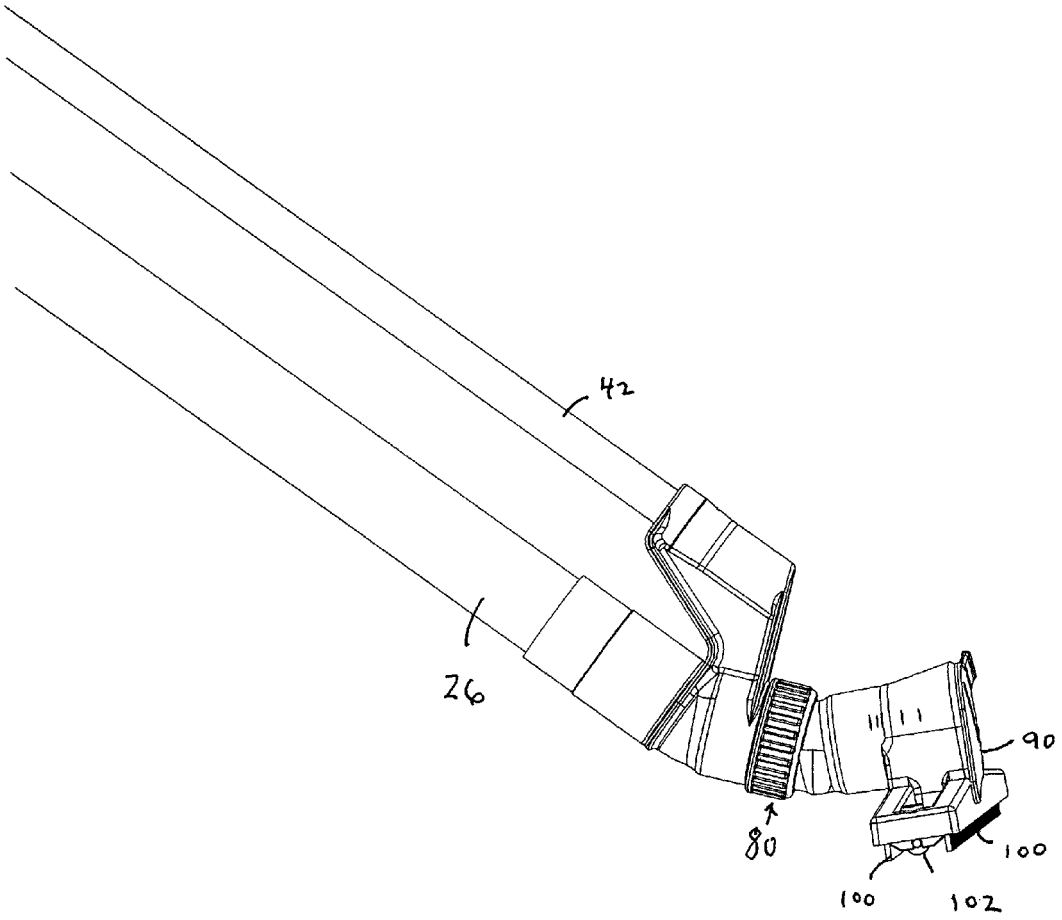
FIG. 12 is a side view of the wand assembly of FIG. 3.
Figure 13:
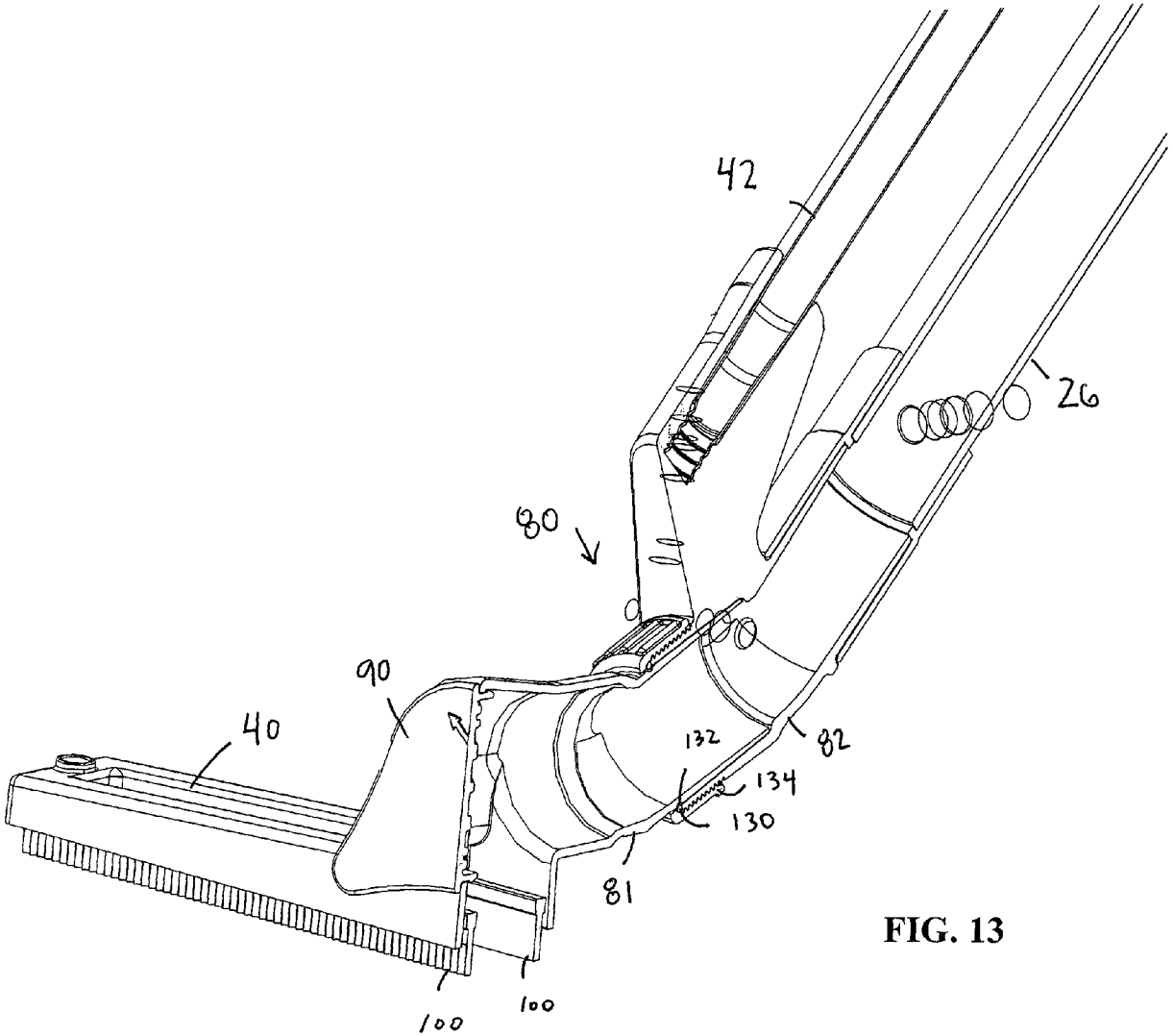
FIGS. 13 and 14 are cross sectional views of the wand assembly of FIG. 3.
Figure 14:
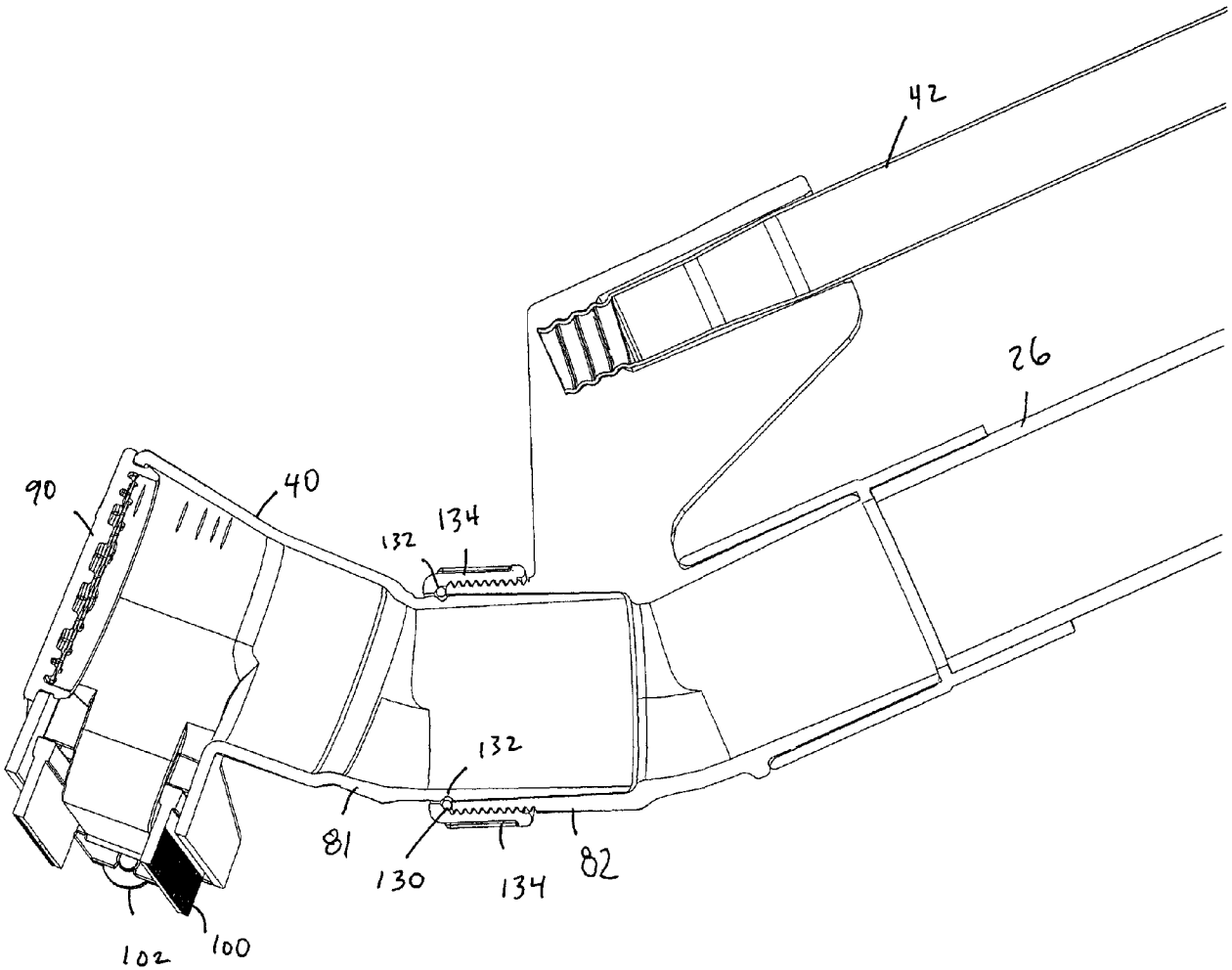

FIG. 12 is a side view of the wand assembly 24, showing the relationship between squeegee blades 100 and rollers 102. FIGS. 13 and 14 are cross sectional views of the wand assembly 24 showing swivel adapter 80. Head member 81 is secured to handle member 82 via ring 130. Ring 130 is adapted to engage a groove 132 in head member 81. A threaded ring 134 holds ring 130 in place and permits head member 81 to swivel relatively freely relative to handle member 82. In the illustrated embodiment, the pivot axis between the head member 81 and handle member 82 is approximately 22.5 degrees. This allows the head 40 to roll along rollers 102 with handle 42 in a comfortable position for the user. When stored, head 40 is pivoted 180 degrees and handle 42 assumes a generally vertical orientation when not in use.

Figure 15:
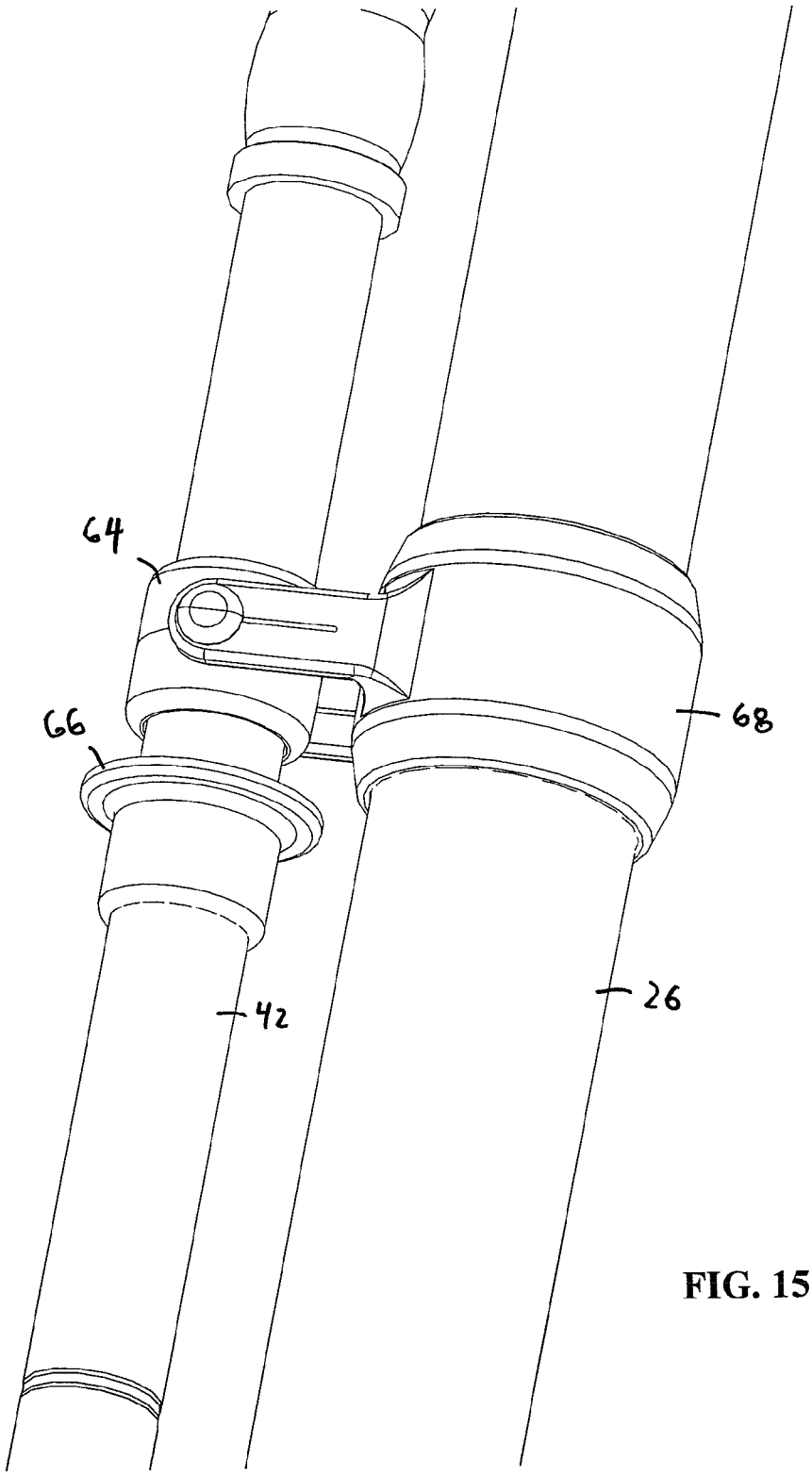
FIGS. 15 and 16 are perspective illustrations of the telescoping handle of the wand assembly of FIG. 3 as attached to a vacuum hose.
Figure 16:
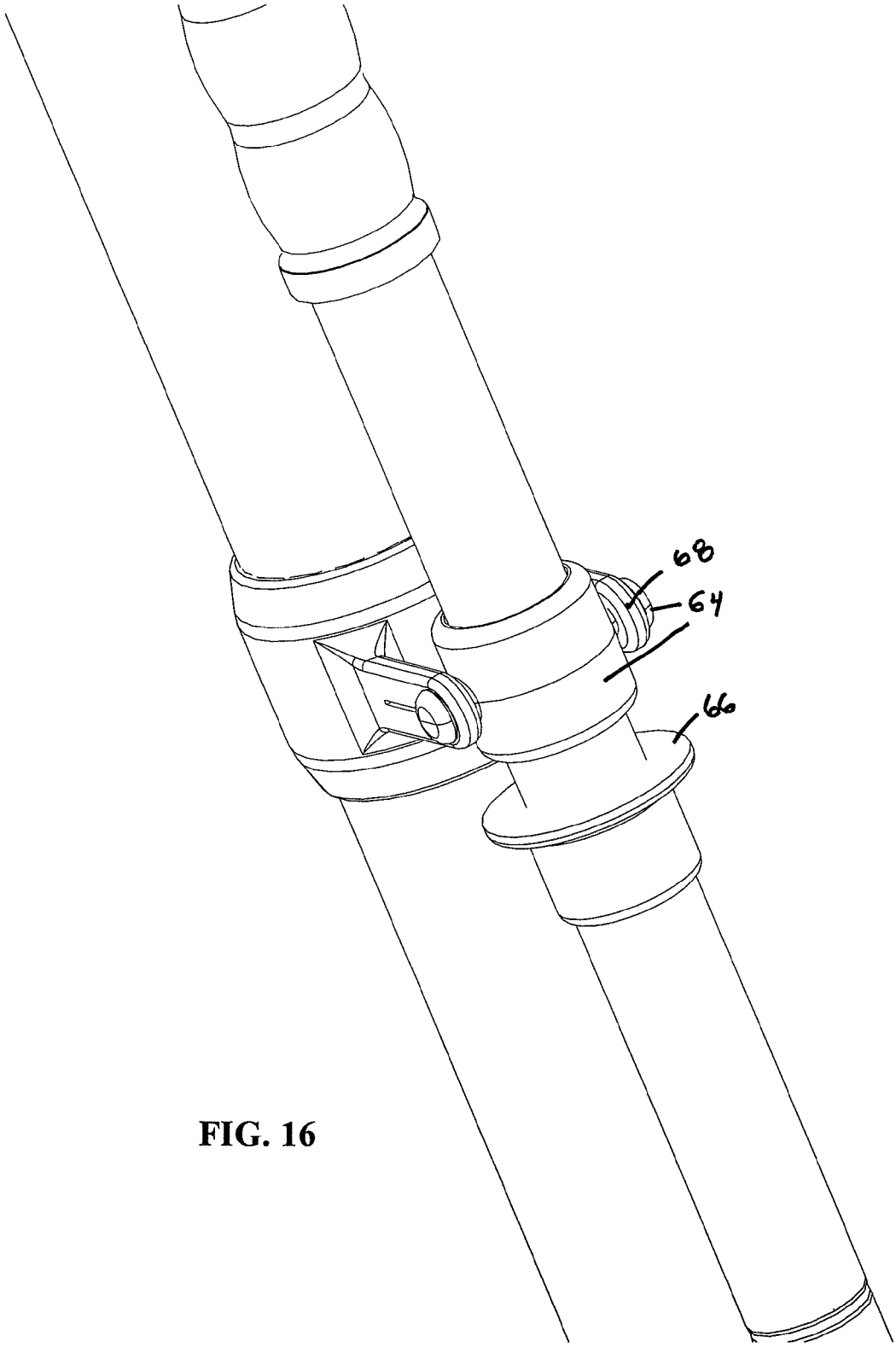

FIGS. 15-16 show a swivel retainer 64, retainer stop 66 and flex retainer 68. Swivel retainer 64 and retainer stop 66 permit handle 42 to rotate (along longitudinal axis) relatively independently relative to vacuum hose 26. Flex retainer 68 couples the handle 42 to the vacuum hose 26. When the handle is expanded in length, swivel retainer 64, stop 66 and flex retainer 68 cooperate to expand a portion of the flexible vacuum tube 26.

When the operator desires to use the wand for debris pickup, handle and pickup head 40 are removed from adapter 29. The vacuum from the vacuum fan remains applied to the hose 26 and the operator need not open a valve so that the vacuum is applied to the hose 26. The operator removes the wand head 40 via the wand coupling 29, expands the collapsible handle to a desired length, and stretches the collapsible hose 26 to whatever length is desired in order to collect debris where it is located. After the operator has used the wand in this manner, the wand may be replaced on the vehicle by collapsing the handle and reinserting the wand head into the adapter 29.

A vehicle incorporating aspects of the present invention thus provides different forms of debris collection including soiled solution recovery via rear squeegee assembly 28 and remote debris recovery via portable wand 24.

Figure 17:
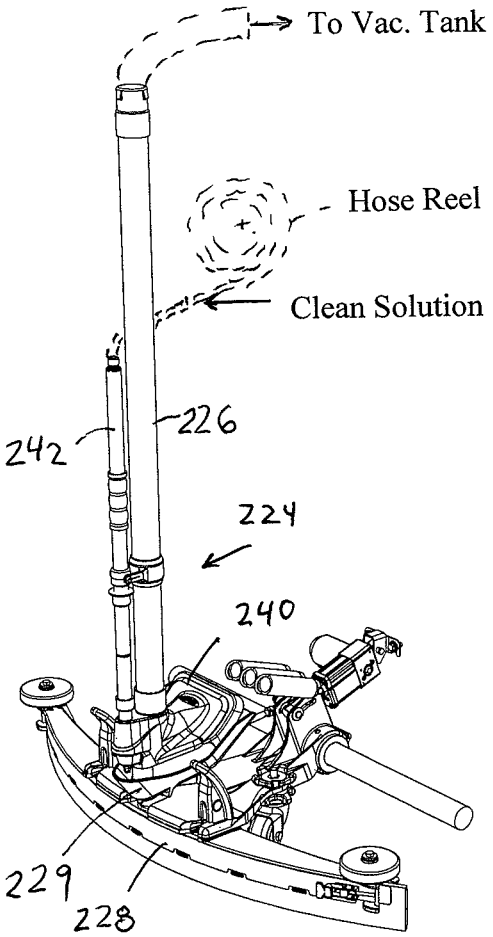
FIGS. 17 and 18 are perspective illustrations of a second embodiment of a wand assembly of the present invention, as attached to a rear squeegee assembly of a surface maintenance machine.

Referring now to FIG. 17, a second embodiment of a wand assembly 224 of the present invention is shown. Wand assembly 224 includes a wand head 240 connected to a tubular, telescoping handle 242 in fluid communication with a cleaning solution source to dispense cleaning solution from nozzle 244 (shown in FIG. 19). Wand head 240 is also connected to vacuum line 226 in communication with a vacuum source. Wand head 240 includes a scrub pad 246 (shown in FIG. 19) used during remote cleaning. Wand head 240 is operative coupled to rear squeegee assembly 228 to communicate a vacuum to rear squeegee assembly 228 to remove debris and soiled cleaning solution from a floor surface.

The wand head 240 is coupled to flexible, collapsible vacuum hose 226. FIG. 17 shows the stored or captured position of wand assembly 224. When stretched to its full extent by the operator's removal of the wand from the vehicle, the hose may permit the operator to collect debris at a distance as great as 15 feet from the cleaning vehicle.

Figure 18:
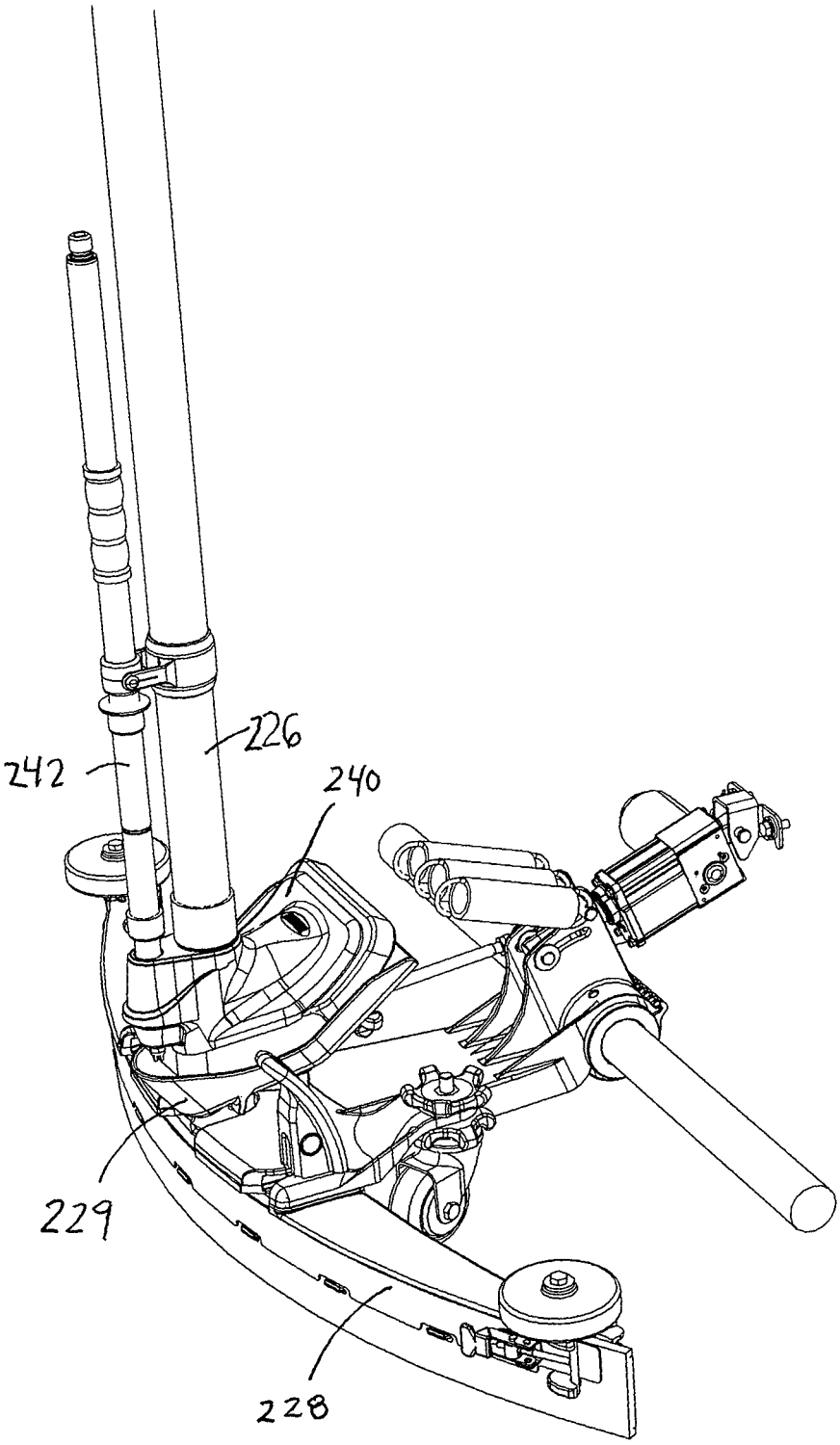
Figure 19:
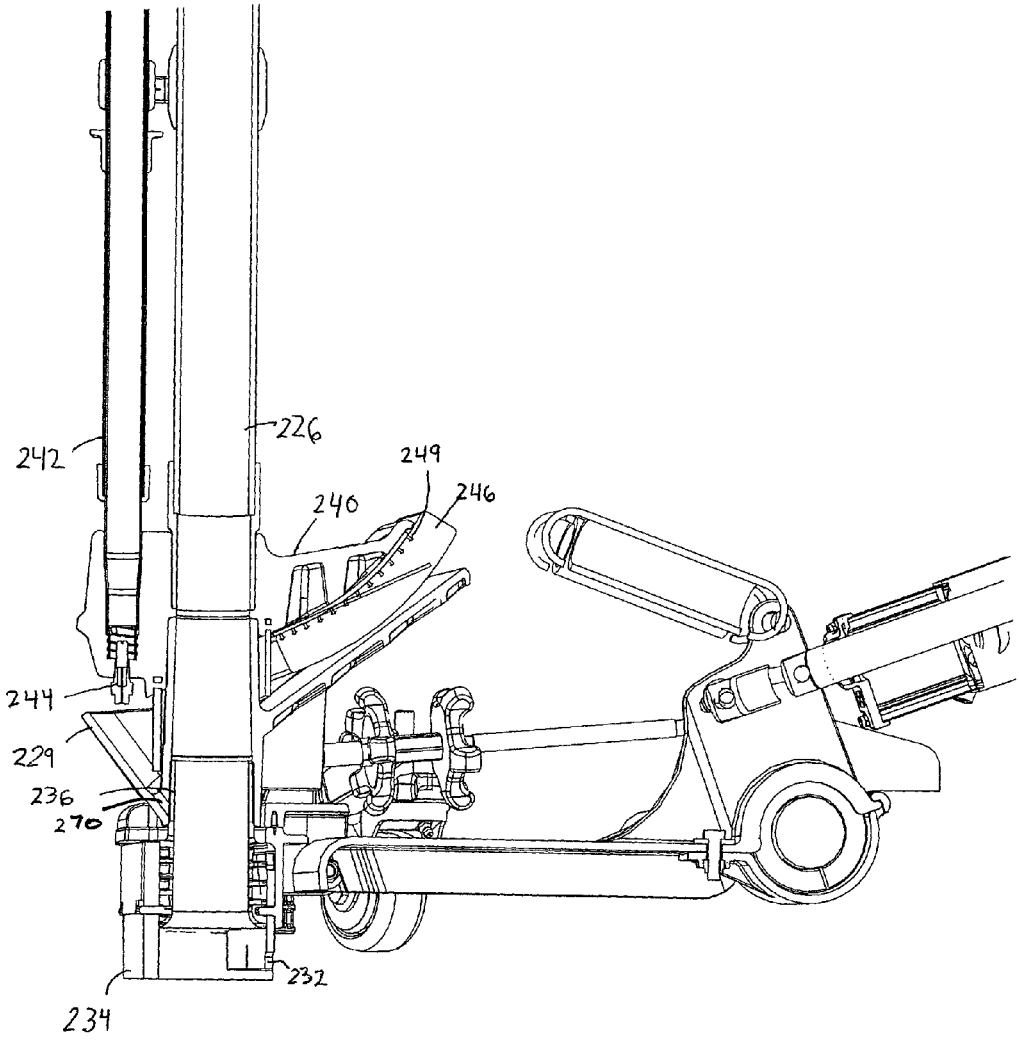
FIG. 19 is a cross sectional view of the wand assembly and rear squeegee assembly of FIG. 17.

Referring to FIG. 18, wand head 240 is supported within adapter 229. FIG. 19 shows the wand assembly 224, adapter 229 and rear squeegee assembly in cross section. Adapter 229 defines a coupling adapted to be secured onto the vacuum outlet 236 of the rear squeegee assembly 228. Rear squeegee assembly 228 includes front blade 232 and rear blade 234. Weep hole 270 allows liquid drops from scrub pad 246 and/or nozzle 240 to be contained by the vacuum system. Scrub pad 246 may be a variety of different scrubbing media. Scrub pad 246 is releasably secured to wand head 240 via a hook-type retainer 249.

Figure 20:
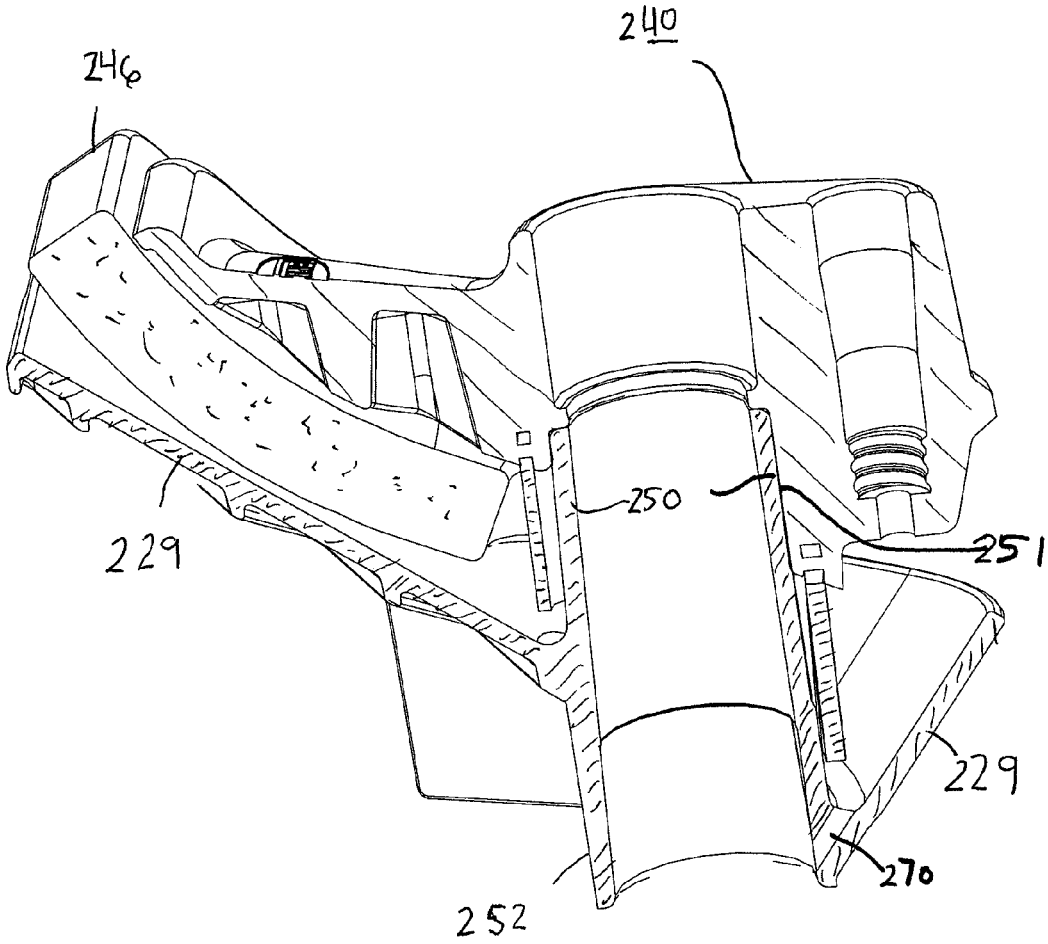
FIG. 20 is a cross sectional view of the wand assembly of FIG. 17 supported within an adapter.

FIG. 20 shows the wand head 240 and adapter 229 in cross section. Adapter 229 defines a male adapter (extension 250) for coupling with a female receptacle (receiving portion 251) at an upper end and a female receptacle (coupling 252) at its lower end for receiving the vacuum outlet 236 of the rear squeegee assembly 228.

Figure 21:
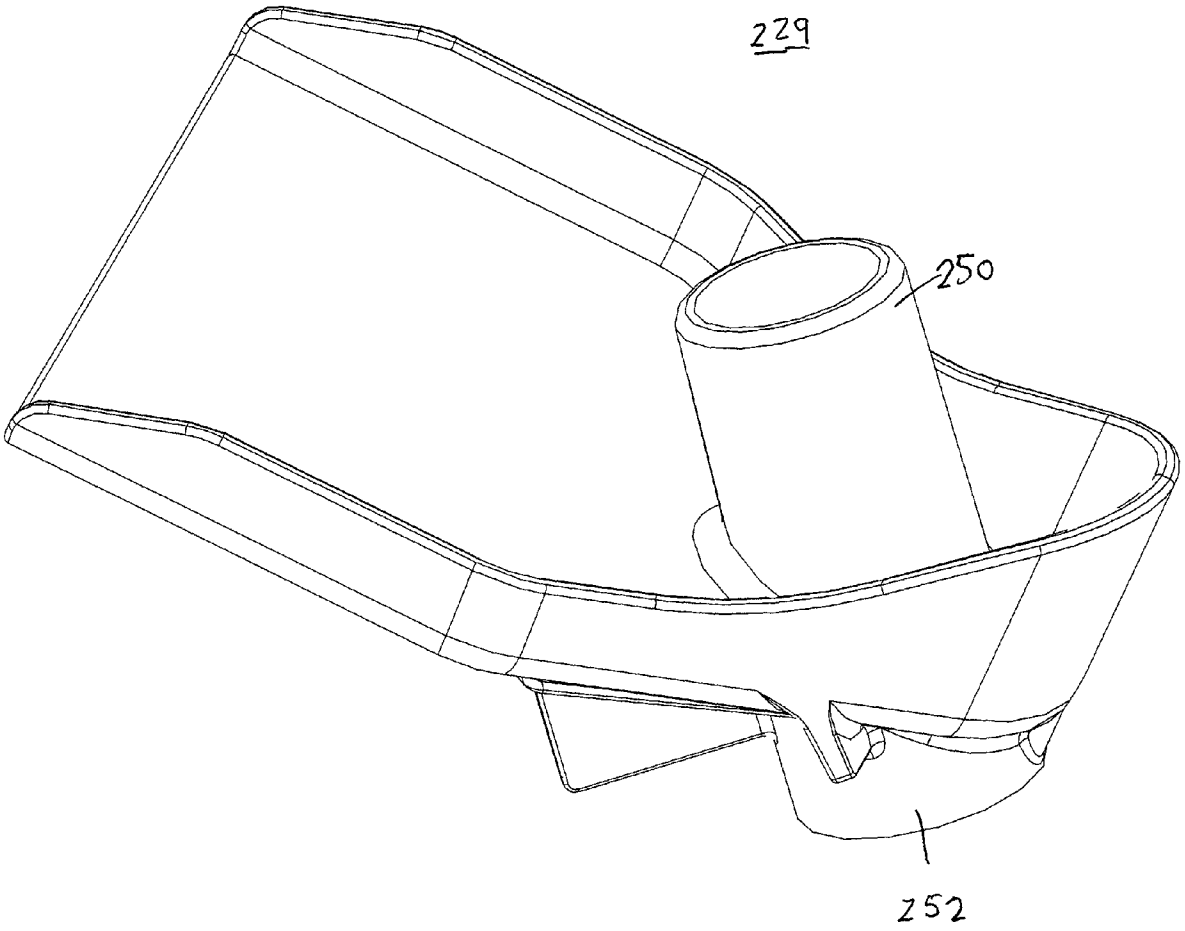
FIG. 21 is a perspective illustration of the adapter of the rear squeegee assembly of FIG. 17.
Figure 22:
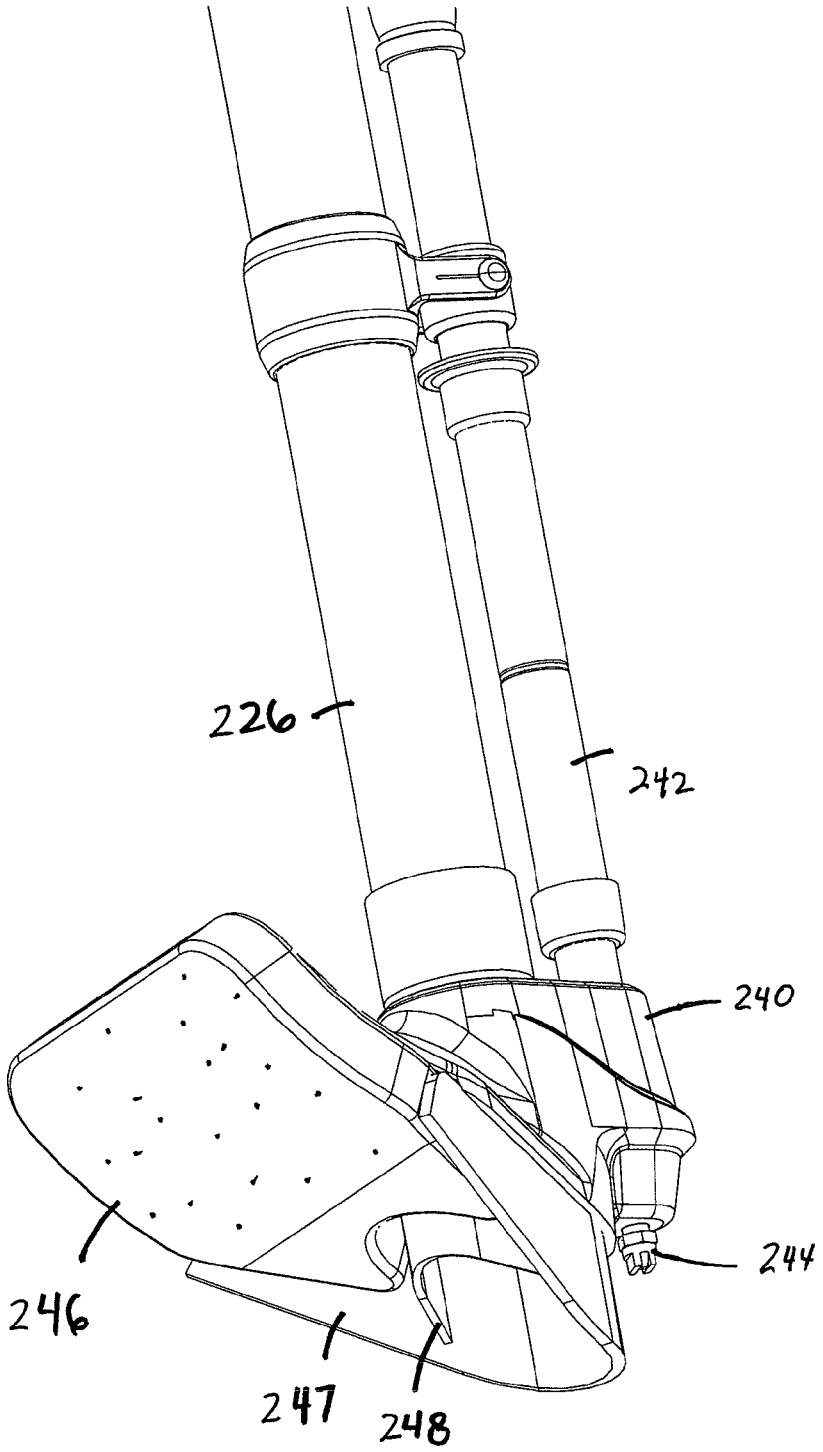
FIGS. 22 and 23 are perspective illustrations of the wand assembly of FIG. 17 as attached to a vacuum line.

FIG. 21 illustrates adapter 229 as removed from rear squeegee assembly 228. FIG. 22 illustrates outer squeegee blade 247 and inner squeegee blade 248 of wand head 240.

Figure 23:
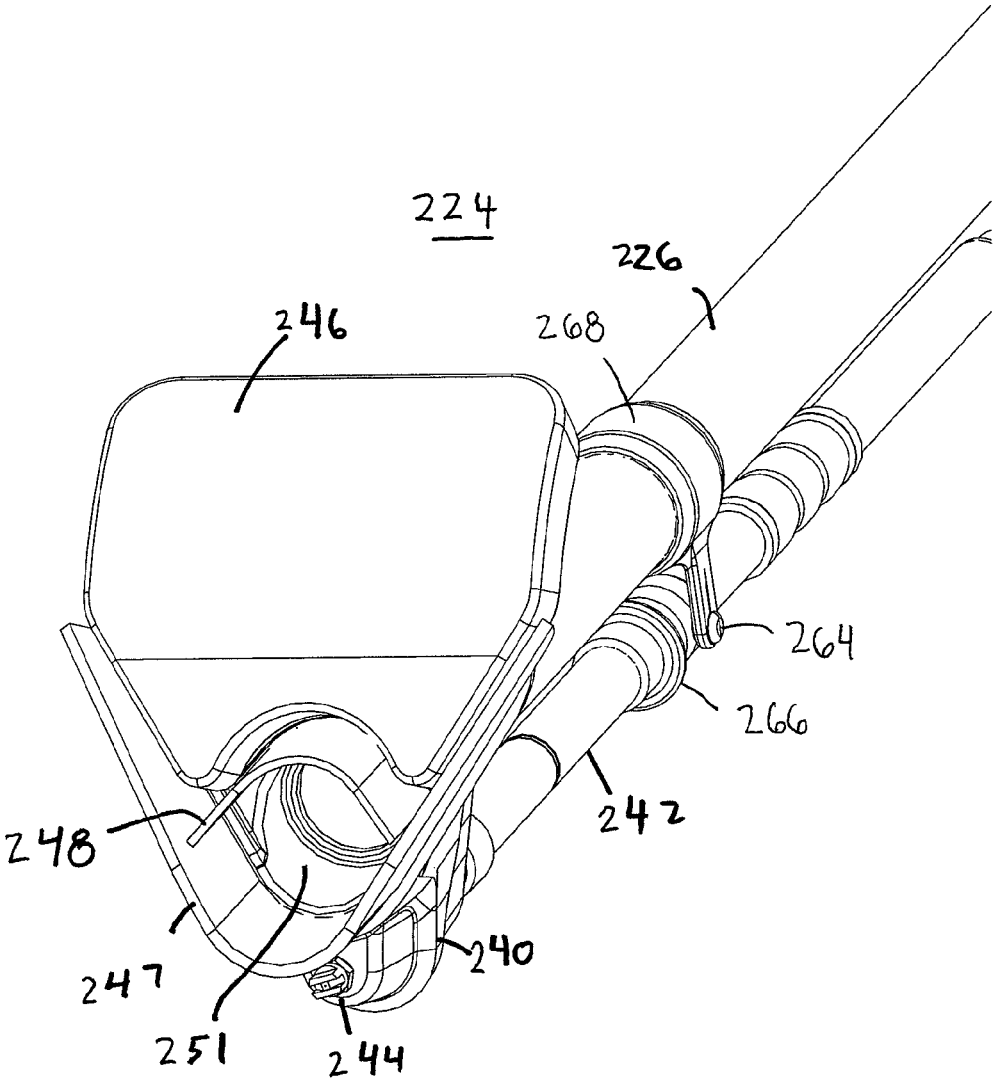

Referring to FIG. 23, vacuum wand assembly 224 includes a swivel coupling including swivel retainer 264, retainer stop 266 and flex retainer 268. The swivel coupling is used to connect the cleaning solution line to handle 242. Swivel retainer 264 and retainer stop 266 permit handle 242 to rotate (along longitudinal axis) relatively independently relative to vacuum hose 226. Flex retainer 268 couples the handle 242 to the vacuum hose 226. When the handle is expanded in length, swivel retainer 264, stop 266 and flex retainer 268 cooperate to expand a portion of the flexible vacuum tube 226. Extension 50 of wand adapter 229 will be partially inserted within a receiving portion 251 of the wand head 240.

When the operator desires to use the wand for debris pickup, handle and pickup head 240 are removed from adapter 229. The vacuum from the vacuum fan remains applied to the hose 226 and the operator need not open a valve so that the vacuum is applied to the hose 226. The operator removes the wand head 240 from the wand adapter 229, expands the collapsible handle to a desired length, and stretches the collapsible hose 226 to whatever length is desired in order to collect debris where it is located. The operator may dispense cleaning solution via nozzle 244 to assist with debris collection. The operator may use scrub pad 246 to assist in debris removal from the floor surface. After the operator has used the wand in this manner, the wand may be replaced on the vehicle by collapsing the handle and reinserting the wand head into the adapter 229. Cleaning solution is dispensed through nozzle 244 via an operator valve (not shown). Solution dripping from pickup head 240 or scrub pad 246 is captured within adapter 229. A weep hole 270 is provided through adapter 229 to allow solution to escape adapter 229.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A floor surface maintenance machine comprising:

a rear squeegee assembly for soiled solution pickup; and a portable vacuum wand for pickup of debris remote from the machine, said vacuum wand being detachable from the rear squeegee assembly and including a handle and a wand head, with a vacuum conduit of the vacuum wand adapted to be coupled to the rear squeegee assembly when not in use so as to provide vacuum to the rear squeegee assembly.

2. The floor surface maintenance machine of claim 1 wherein the handle is telescopic and extends for use during remote debris pickup.

3. The floor surface maintenance machine of claim 2 including a retainer for connecting the handle to the vacuum conduit.

4. The floor surface maintenance machine of claim 3 wherein said retainer includes a swivel connection.

5. The floor surface maintenance machine of claim 1 wherein the wand head includes a plug which pivots to close a vacuum port.

6. The floor surface maintenance machine of claim 5 wherein the vacuum port engages a vacuum outlet of the rear squeegee assembly when the vacuum wand is stored on the machine.

7. The floor surface maintenance machine of claim 1 wherein the handle is telescopic and a handle interior is in fluid communication with a cleaning solution.

8. The floor surface maintenance machine of claim 7 wherein the cleaning solution is dispensed out of said wand head via a nozzle in communication with the handle interior.

9. The floor surface maintenance machine of claim 1 further comprising:

operating the machine in a first mode of operation wherein the rear squeegee assembly is used to recover soiled cleaning solution upon the floor surface, with recovered cleaning solution being transported via vacuum action through the vacuum conduit;

operating the machine in a second mode of operation wherein the portable vacuum wand is removed from the machine and used to remove debris from a location remote from the machine, wherein debris is transported via vacuum action through said vacuum conduit; and returning to said first mode of operation by connecting the vacuum wand to the rear squeegee assembly.

10. The floor surface maintenance machine of claim 9 wherein said returning to the first mode of operation includes inserting a vacuum outlet port of the rear squeegee assembly into a port on the vacuum wand.

11. The floor surface maintenance machine of claim 9, wherein said operating the machine in the second mode of operation includes extending a telescopic handle attached to the vacuum conduit.

12. The floor surface maintenance machine of claim 9 wherein said operating the machine in the second mode of operation includes dispensing a cleaning solution from the vacuum wand.

13. The floor surface maintenance machine of claim 12 wherein said dispensing includes conveying the cleaning solution through a handle of the vacuum wand.

14. A floor surface maintenance machine comprising:

a vacuum system for recovering debris;

a portable vacuum wand having a wand head remaining in communication with said vacuum system whether the wand is operational or being stored on said machine; and a rear squeegee assembly for recovering soiled cleaning solution when the portable vacuum wand is stored on said machine, with recovered soiled cleaning solution passing through the portable vacuum wand head during operation of the machine.

15. The floor surface maintenance machine of claim 14 further comprising:

a swivel connection between the wand head and a handle, with said swivel connection allowing the wand head to swivel relative to the handle.

16. The floor surface maintenance machine of claim 15 wherein the handle is telescopic.

17. The floor surface maintenance machine of claim 14 further comprising a handle coupled to a cleaning solution source and a nozzle in fluid communication with the handle to spray cleaning solution on a floor surface.

18. The floor surface maintenance machine of claim 14 wherein the wand head includes a port adapted to engage a vacuum outlet of the rear squeegee assembly.

19. The floor surface maintenance machine of claim 18 wherein the port is closed by a plug during remote use of the vacuum wand.

20. The floor surface maintenance machine of claim 14 wherein the wand head includes a scrub pad.

21. A floor surface maintenance machine comprising:

a vacuum system for recovering debris;

a rear squeegee assembly for recovering soiled cleaning solution directly from a floor surface; and portable vacuum wand having a wand head remaining in communication with said vacuum system whether the wand head is used to recover a soiled cleaning solution remote from a machine chassis or the wand head is directly coupled to the rear squeegee assembly so that soiled cleaning solution is recovered through said rear squeegee assembly.

22. The floor surface maintenance machine of claim 21 further comprising a handle coupled to a cleaning solution source and a nozzle in fluid communication with the handle to spray cleaning solution on a floor surface.

23. The floor surface maintenance machine of claim 21 wherein the wand head includes a port adapted to engage a vacuum connection of rear squeegee assembly.

24. The floor surface maintenance machine of claim 23 wherein the port is closed by a plug during remote use of the vacuum wand.

25. The floor surface maintenance machine of claim 21 wherein the wand head includes a scrub pad.

* * * * *